United States Patent [19]

Parry et al.

[11] 4,326,466

[45] Apr. 27, 1982

[54] ANTI-BACK UP DEVICE FOR CONVEYOR TROLLEY

[75] Inventors: James L. Parry, Detroit; Martin J. Redden, Emmett; Albert Goldstein, Southfield, all of Mich.

[73] Assignee: ACCO Industries Inc., Bridgeport, Conn.

[21] Appl. No.: 130,204

[22] Filed: Mar. 13, 1980

[51] Int. Cl.[3] ..... B61B 10/02; B61C 13/06

[52] U.S. Cl. ..... 104/172 S; 105/148; 188/61

[58] Field of Search ..... 104/172 S, 250; 188/42, 188/43, 61; 105/148, 154, 155

[56] References Cited

U.S. PATENT DOCUMENTS

| | | | |
|---|---|---|---|
| 3,200,768 | 8/1965 | Harrison | 104/172 S |
| 3,548,752 | 12/1970 | Karlstrun | 104/172 S |
| 3,759,189 | 9/1973 | Desilets | 104/172 S |
| 3,986,458 | 10/1976 | Kling | 104/172 S |

FOREIGN PATENT DOCUMENTS

| | | | |
|---|---|---|---|
| 468845 | 7/1975 | U.S.S.R. | 104/172 S |
| 701879 | 12/1979 | U.S.S.R. | 104/172 S |

*Primary Examiner*—Randolph A. Reese

*Attorney, Agent, or Firm*—Barnes, Kisselle, Raisch & Choate

[57] ABSTRACT

A conveyor system comprising a track along which a plurality of carriers are movable. Each carrier includes a pusher dog that is movable into and out of position for engagement by a pusher lug of a conveyor chain. Each carrier is provided with wheels, and a pivoted anti-back up cam member which is normally urged by gravity in a direction to hold surfaces thereof out of engagement with the track. Each carrier further includes an actuator operable when it engages a preceding carrier or an obstacle to move the pusher dog out of engagement with the pusher lug. A spring is provided between the actuator and the anti-back up cam member so that when the actuator is operated to move the pusher dog, the cam member frictionally engages the track.

14 Claims, 4 Drawing Figures

ANTI-BACK UP DEVICE FOR CONVEYOR TROLLEY

This invention relates to conveyor systems and particularly to power and free conveyor systems.

BACKGROUND AND SUMMARY OF THE INVENTION

In power and free conveyor systems, it is common to have a plurality of carriers that are movable along a track by engagement with a conveyor chain. In order to accommodate obstacles or accumulation of the carriers, it is common to have a movable pusher dog on each carrier which is movable into and out of position for engagement with a lug of a conveyor chain. When the pusher dog is moved out of engagement with the lug of the conveyor chain and the movement of the carrier is thus stopped on the track, it is desirable to provide a brake to prevent retrograde movement of the carrier along the track.

It has heretofore been suggested that a cam brake member be provided on each carrier which is urged by gravity into engagement with the wheels of the carrier such as shown in U.S. Pat. No. 3,548,752. An arrangement wherein pivot parts engage the track is shown in U.S. Pat. No. 3,357,369.

Among the objects of the invention are to provide a conveyor system which utilizes an improved simple, effective, economical brake system that is operable when the pusher dog is moved in a direction to disengage it from the lug of the conveyor chain.

In accordance with the invention, an anti-back up cam member is pivoted through spring means to engage the bottom of the free track and is operated by the actuator which also moves the pusher dog out of the path of the pusher lug on the conveyor to engage the track.

DESCRIPTION

Figure 1:
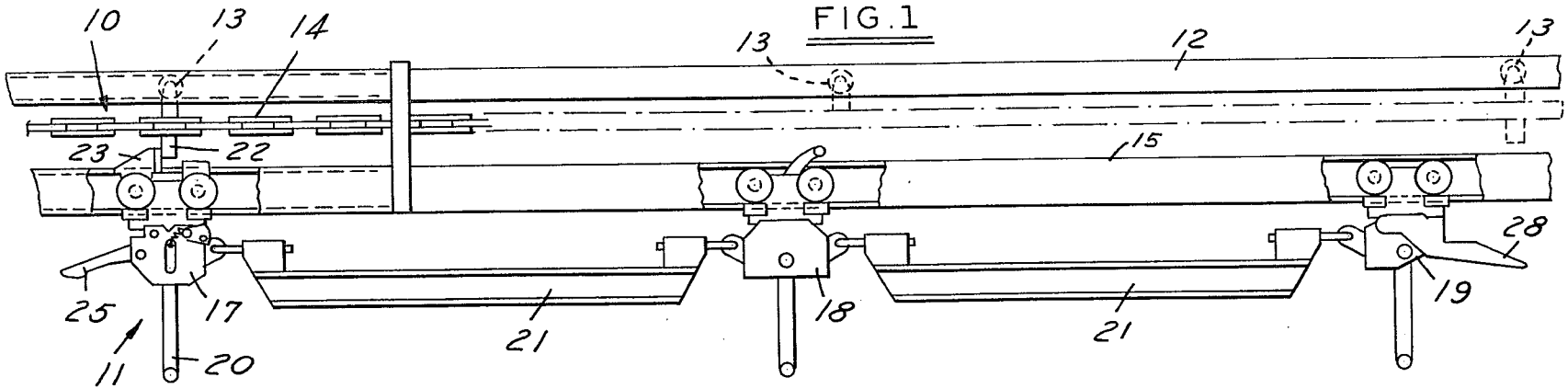
FIG. 1 is a partly diagrammatic side elevational view of a conveyor system embodying the invention.

Referring to FIG. 1, a conveyor system comprises a track 10 along which a plurality of carriers 11 are moved. The system further includes a conveyor chain track 12 along which the wheeled trolleys 13 of a conveyor chain 14 are moved.

Figure 4:
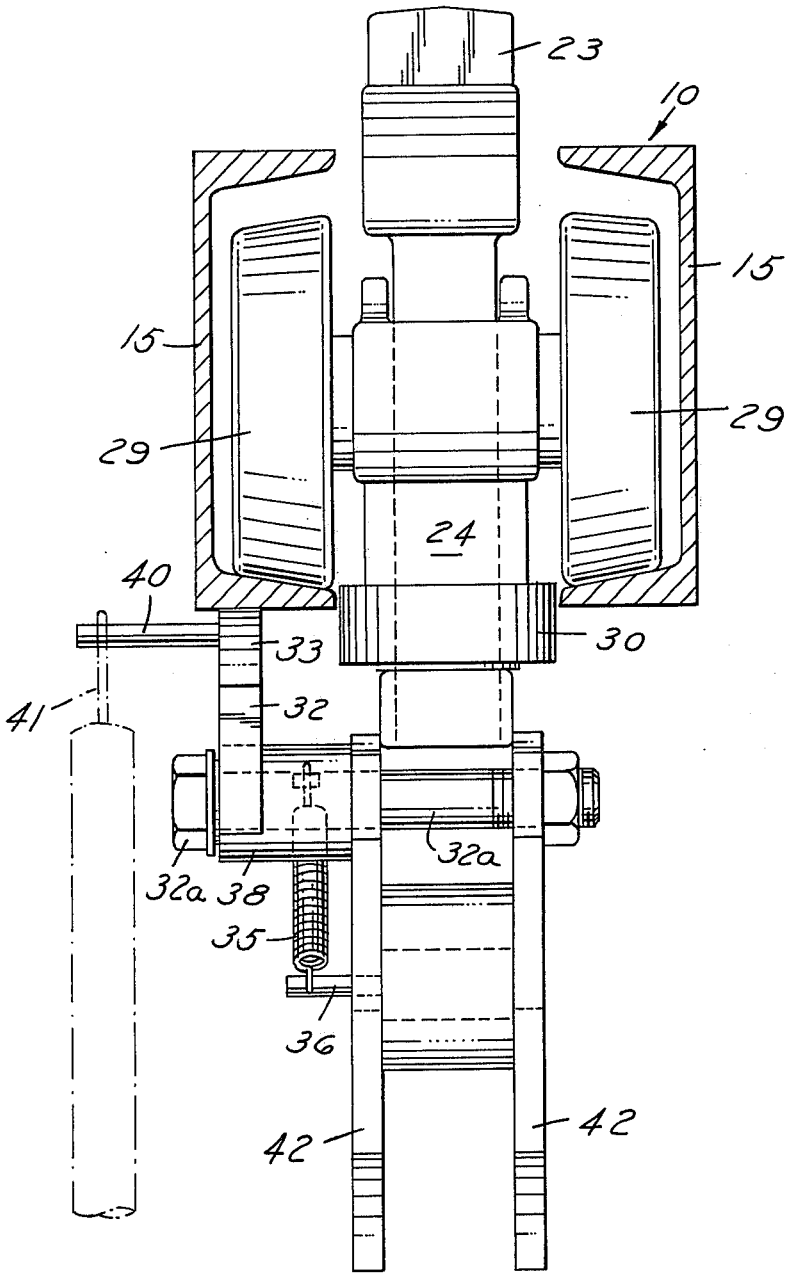
FIG. 4 is a sectional view taken along the line 4—4 in FIG. 2.

As shown in FIGS. 1 and 4, the track 10 comprises inwardly facing channels 15. Carrier 11 comprises one or more trolleys herein shown as having a leading trolley 17, an intermediate trolley 18 and a trailing trolley 19 interconnected by pivoted tie bars 21 (FIG. 1). Some of the trolleys support a load through C-hooks 20.

Figure 2:
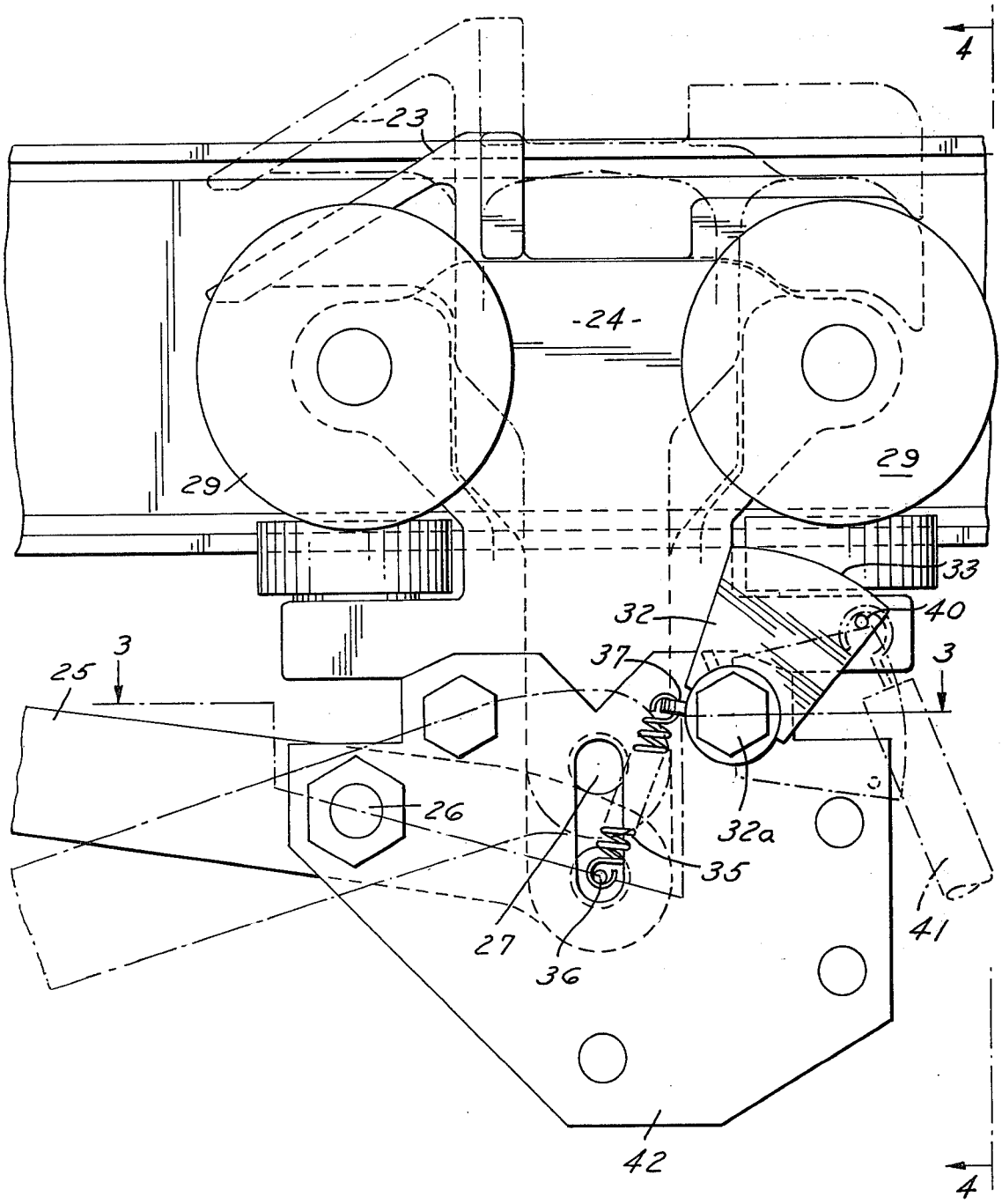
FIG. 2 is a fragmentary side elevational view on an enlarged scale of a portion of a carrier utilized in the system shown in FIG. 1, parts being broken away.

As shown in FIGS. 1 and 2, the conveyor chain 14 includes downwardly extending pusher lugs 22 which are adapted to engage movable pusher dog 23 on the front trolley 17 of the carrier 11.

As shown in FIG. 2, pusher dog 23 is movable generally vertically within hollow body 24 of front trolley 17.

A lever 25 is pivoted intermediate its ends at 26 on side plates 42 on body 24 and to the lower end of pusher dog 23 as at 27. The lever 25 extends forwardly and is adapted to engage a rearwardly extending member 28 on the rear trolley 19 of a preceding carrier. When lever 25 engages member 28, it is pivoted clockwise as viewed in FIGS. 1, 2 bringing it to the solid line position out of engagement by the pusher lugs 22. Thus, the movement of the carrier is interrupted along the track 10.

Figure 3:
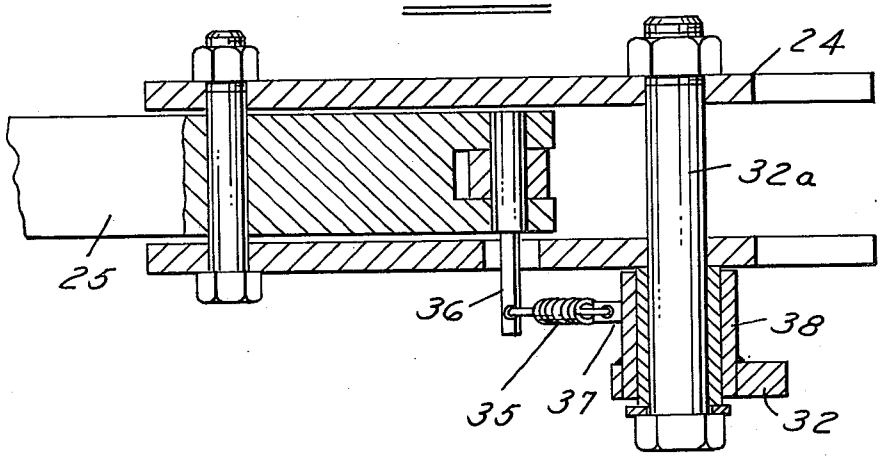
FIG. 3 is a fragmentary sectional view taken along the line 3—3 in FIG. 2.

As shown in FIGS. 3 and 4 the body 24 supports longitudinally spaced pairs of wheels 29 that ride on the upper surface of the lower flanges of track members 15 and guide rollers 30 which are rotatable about vertical axes and are adapted to engage the edges of the lower flanges of channel members 15 (FIG. 4).

An anti-back up cam member is pivoted on a pin **32*a* beneath wheels 30 along one or both sides of the carrier body 24. Anti-back up cam member 32 is mounted eccentrically with respect to its center of gravity so that its weight tends to rotate it out of engagement with the under surface of the lower flanges of track members. Anti-back up cam member 32 includes a curved track engaging surface 33, which is preferably knurled or serrated. Surface 33 is straight in transverse cross section and has an increasing radius longitudinally from front to rear so that, as it is rotated upwardly into engagement with the lower surface of track member 15, and any tendency of the carrier 17 to move backwards causes it to jam against the track member 15**.

A yielding connection is provided between cam members 32 and lever 25 by a tension spring 35 connected at one end to a pin 36 on lever 25 and connected at the other end to a tab 37 of a tube 38 fastened to cam member 32.

In order to be able to manually move a carrier backward when it is stopped a lateral projection 40 is provided on the anti-back up cam member which can be engaged manually by a hook 41 or other device to pull cam member 32 down permitting the carrier to be moved backward manually. Alternatively, a rope or chain can be attached to projection 40 so that pulling thereof will disengage the cam member.

When the lever 25 is in its normal position shown in broken lines in FIG. 2, the anti-back up cam member 32 is pivoted by its weight out of engagement with the track member 15. When lever 25 encounters an obstacle or a preceding carrier, it is pivoted, clockwise as viewed in FIG. 2 to the solid line position, moving the cam member 32 into engagement with the track member 15. Any tendency of the carrier 11 to move rearwardly causes the anti-back up cam member 32 to jam tighter against the track members 15 due to the increasing radius of surface 34 rearwardly. If the carrier 11 moves forward, the cam member tends to rotate and move away from tight engagement due to the decreasing radius of surface 34 forwardly. Spring 35 provides a resilient connection between lever 25 and cam member 32 so the action is cushioned.

An anti-back up cam member can be provided on either or both sides of the carrier depending on the load and degree of braking required.

We claim:

1. A power and free conveyor system comprising a track, at least one carrier movable along said track, a conveyor for driving said carrier along said track, pusher means on said carrier movable into and out of driving engagement with said conveyor, operating means comprising a lever pivoted intermediate its ends on said carrier and having one end extending forwardly and the other end extending rearwardly, said lever being operable to move said last mentioned pusher means out of driving engagement with said conveyor upon contact with a preceding carrier or an obstacle, an anti-back up cam member movably mounted on said carrier and adapted to be moved into and out of engagement with said track, tension spring means providing a yielding connection between said cam member and said lever such that when said lever operates to move said pusher means out of engagement with said conveyor, said cam member is yieldingly urged into engagement with said track.

2. The power and free conveyor system set forth in claim 1 wherein said track includes a lower surface, said cam member including a cam surface adapted to engage said lower surface.

3. The power and free conveyor system set forth in claim 2 wherein said cam surface is curved and has an increasing radius from front to rear with respect to the direction of movement of the carrier.

4. The power and free conveyor system set forth in claim 1 wherein said track comprises spaced channels each of which has lower surfaces, said cam member including a cam surface adapted to engage one of said surfaces.

5. The power and free conveyor system set forth in claim 4 wherein said cam surface is curved and has an increasing radius from front to rear with respect to the direction of movement of the carrier.

6. The power and free conveyor system set forth in claim 5 wherein said cam surface is knurled.

7. The power and free conveyor system set forth in claim 1 including means on said anti-back up cam member adapted to be manually engaged for moving said cam member downwardly thereby permitting manual movement of said carrier along said track.

8. The power and free conveyor system set forth in claim 1 wherein said tension spring means comprises a tension spring extending between the rear end of said lever and said cam means.

9. For use in a power and free conveyor system:

a carrier adapted for movement along said track, pusher means on said carrier movable into and out of position for driving engagement with a conveyor, operating means comprising a lever pivoted intermediate its ends on said carrier and having one end extending forwardly and the other end extending rearwardly, said lever being operable to move said last mentioned pusher means out of driving engagement with said conveyor upon contact with a preceding carrier or an obstacle, an anti-back up cam member movably mounted on said carrier and adapted to be moved into and out of engagement with said track, tension spring means providing a yielding connection between said cam member and said lever such that when said lever operates to move said pusher means out of engagement with said conveyor, said cam member is yieldingly urged into engagement with said track.

10. The carrier set forth in claim 9 wherein said cam member including a cam surface adapted to engage a lower surface of a track.

11. The carrier set forth in claim 10 wherein said cam surface is curved and has an increasing radius from front to rear with respect to the direction of movement of the carrier.

12. The power and free conveyor system set forth in claim 11 wherein said cam surface is knurled or serrated.

13. The carrier set forth in claim 9 including means on said anti-back up cam member adapted to be manually engaged for moving said cam member downwardly thereby permitting manual movement of said carrier along said track.

14. The carrier set forth in claim 9 wherein said tension spring means comprises a tension spring extending between the rear end of said lever and said cam means.

* * * * *